US005194181A

United States Patent [19]

Reitz

[11] Patent Number: 5,194,181

[45] Date of Patent: Mar. 16, 1993

[54] PROCESS FOR SHAPING ARTICLES FROM ELECTROSETTING COMPOSITIONS

[75] Inventor: Ronald P. Reitz, Hyattsville, Md.

[73] Assignee: The United States of America as represented by the Secretary of the Navy, Washington, D.C.

[21] Appl. No.: 405,178

[22] Filed: Sep. 11, 1989

Related U.S. Application Data

[63] Continuation-in-part of Ser. No. 219,522, Jul. 15, 1988, and a continuation-in-part of Ser. No. 219,523, Jul. 15, 1988, abandoned.

[51] Int. Cl.[5] ..... B29C 35/00; B29C 39/00

[52] U.S. Cl. ..... 252/500; 252/511; 252/512; 252/518; 252/572; 252/73; 252/74; 264/22; 264/24; 264/25; 264/26; 219/10.41; 219/10.53; 219/10.81

[58] Field of Search ..... 252/511, 512, 518, 74, 252/73, 77, 78.1, 78.3, 79, 572; 204/3, 130, 164; 264/24, 26, 22, 25; 219/10.53, 10.81, 10.41

[56] References Cited

U.S. PATENT DOCUMENTS

| | | | |
|---|---|---|---|
| 4,301,187 | 11/1981 | Burch | 427/45.1 |
| 4,407,054 | 10/1983 | Zipfel, Jr. | 252/62.9 |
| 4,423,191 | 12/1983 | Haven et al. | 264/26 |
| 4,441,875 | 4/1984 | Saito et al. | 264/24 |
| 4,707,231 | 11/1987 | Berger | 264/24 |
| 4,826,616 | 5/1989 | Tanino et al. | 252/62.9 |
| 4,857,244 | 8/1989 | Berger | 264/24 |
| 4,879,056 | 11/1989 | Fihsko et al. | 252/74 |
| 4,900,387 | 2/1990 | Johnson | 156/272.2 |
| 4,921,928 | 5/1990 | Tanino et al. | 204/157.82 |

*Primary Examiner*—Paul Lieberman
*Assistant Examiner*—Bradley A. Swope
*Attorney, Agent, or Firm*—Luther Marsh; John Stowe; Charles Miller

[57] ABSTRACT

A phase changing composition for making articles that can be influenced as to shape and cure time by the application of an electric field. Also disclosed are apparatus and processes for using the material. The composition is characterized in that under the influence of an electrostatic field, the cure time of the composition is significantly shorter.

19 Claims, 3 Drawing Sheets

PROCESS FOR SHAPING ARTICLES FROM ELECTROSETTING COMPOSITIONS

CROSS REFERENCE TO RELATED APPLICATIONS

This application is a continuation in part of my copending patent application Ser. No. 07/219,522 pending and 07/219,523, now abandoned, both filed Jul. 15, 1988.

BACKGROUND OF THE INVENTION

1. Field of the Invention

This invention relates to the field of compositions that are intended to change state from a flowable to a less flowable substance after application to an intended use and more particularly to compositions wherein it is desirable for this change of state to take place as rapidly as possible.

2. Background Information

The invention disclosed herein is a continuation in part of work previously accomplished and for which copending patent applications were filed on Jul. 15, 1988 as Ser. Nos. 07/219,522 pending and 07/219,523, now abandoned the disclosures of which are hereby incorporated by reference. The present invention is related to electroviscous fluids in a way that will be discussed below. My copending application Ser. No. 07/219,522 pending disclosed an induced dipole electroviscous fluid, comprising a dielectric fluid and a multiplicity of electrically polarizable aggregate particles dispersed in the dielectric fluid. Within the fluid, a substantial portion of the aggregate particles each further comprise a core and an electrically nonconductive sh'eld, the core being at least partially electrically conductive and the shield partially encompassing the core and adapted to prevent particle to particle transmission of electric current. Alternately, the shield further comprises a shell for completely encapsulating the core. When an encapsulating shell is used, the core of the aggregate particle may be an electrolyte, the purpose of the shell in this instance being to prevent the electrolyte from migrating into and degrading the dielectric fluid. The performance of the electroviscous fluid is enhanced by incorporating in each aggregate particle at least one buoyant body, the purpose of the buoyant body being to equalize the effective density of the aggregate with the density of the dielectric fluid, thus enhancing the ability of the aggregate to stay in suspension for long periods of time. Buoyant bodies may be created as gas pockets in the shield or adhesively attached to the core using such as for example, glass microspheres or hollow plastic bodies. Glass microspheres having a density of 0.2 g/cc are especially useful as buoyant bodies. The core is made of any convenient conductive or semiconductive material and when a shell is used, the core can be a liquid or composite electrolyte.

Electroviscous fluids refer to fluids which exhibit the property of increased viscosity when the fluid is subjected to an electric field. One phenomenon for electrically controlling the viscosity of a fluid is commonly known as the Winslow effect. The term Winslow effect refers to the phenomenon of electrically controlling the viscosity of a fluid comprising a suspension of finely divided electrically polarizable matter in a dielectric fluid by subjecting the fluid to an electric field. Within this disclosure and the appended claims, the finely divided electrically polarizable matter is referred to as aggregate.

Numerous types of electroviscous fluids and aggregates are disclosed in my copending applications referenced above as well as in the prior art. Electroviscous fluids and aggregates for electroviscous fluids are disclosed in the prior art in U.S. Pat. Nos.: 4,687,589; 3,427,247; 3,970,573; 3,984,339; 4,502,973; 4,737,886, the disclosures of which are hereby incorporated by reference.

It is known that molded articles can be made by pouring a phase changing vehicle into a form, allowing the vehicle to set or cure and then removing the molded article from the mold. As used herein the term phase changing vehicle applies to any composition which changes state from a flowable to a less flowable or solid state when such compositions cure or set in the normal course of their use. Numerous commercially available compositions are available which exhibit such phase changing characteristics, examples of which are hereinafter disclosed. These include vehicles made from mixing multipart constituents which chemically react and vehicles having a contituent or a composition of constituents which reacts with its surroundings such as for example air.

SUMMARY OF THE INVENTION

It has been found that aggregates as are suitable for use as aggregates in electroviscous fluids may be advantageously put to other purposes. When a suitable electroviscous fluid aggregate is added to a phase changing vehicle, an electroviscous fluid is formed whereby the fluid is susceptible of being held in place by the Winslow effect during the time of phase change of the composition. Suprisingly, it has been found that a composition comprising electroviscous fluid aggregate in a phase changing vehicle will, when the composition is subjected to an electric field, set or cure much more rapidly than the same composition sets or cures when not under the influence of an electric field. The phenomonenon of accelerated curing of such a composition is referred to as the second Reitz effect.

Within this disclosure and the appended claims, the term electroset composition is used to relate to a composition which is susceptible to being shaped or cured by influence of an applied electric field.

An electroset composition comprises a phase changing vehicle and an electrically polarizable aggregate. The term aggregate is used in the collective to include a multiplicity of polarizable particles. The composition is responsive to an applied electric field in that the field cooperates to hold the material in place while the material cures and to drastically accelerate the cure of the material.

One aggregate as disclosed in my copending application Ser. No. 07/219,522 pending was tested and found to be useful for the purposes of the present invention. Thereafter, it was found that aggregates other than those of my copending application were also useful in forming electroset compositions in accordance with the present invention. Consequently it is expected that any of the aggregates disclosed in my copending application as well as any of the aggregates disclosed in the prior art as generally useful for making electroviscous fluids are also generally useful as aggregates for forming electroset compositions. Aggregates suitable for use in an electroset composition include those suitable for use as aggregates for electroviscous fluids.

Preferably the phase changing vehicle has good dielectric properties so that current flow in the electric field is kept to a minimum. Also, it is preferable if the density of the aggregate particles is matched to the density of the phase changing vehicle so that the patic-les are maintained uniformly suspended in the composition.

It is an object of the invention to provide material compositions having a characteristic of accelerated curing or setting when the composition is under the influence of an electric field.

Another object of the invention is to provide a material which is held into a predetermined shape by an electric field while the material is curing.

Still another object is to provide a composition that is susceptible to accelerated curing by the application of an electric field.

Yet another object of the present invention is to provide a method and material for making molded articles.

Still another object of the present invention is to provide a method of making molds or forms for making molded articles.

The advantages of the compositions and methods will be readily understood by those skilled in the art in the light of this disclosure. While it is known that many materials may be initially fluid enough to be injected into a mold and permitted to harden into solids, many of these materials have slow cure times, that is, they do not harden rapidly into an identifiable and transportable form. On the other hand, an electroset composition can be cast into a mold and held in place and cured by the application of an electric field.

Another advantage is that the materials of the invention may have their cure rate electrically determined, accelerating the cure with a high potential, low energy consumption electric field as opposed to accelerating the cure by conventional means such as heating the material and its surrounding area or adding additional catalyst. The accelerated cure overcomes another objections to curing material in the conventional way. For example, some moldable materials give off an offensive odor as they cure. Such a material is RTV silicone rubber which gives off a pungent acetic acid odor as it sets and cures. Accelerating the cure reduces the time that these odors will be offensive to persons in the surrounding area.

Yet another advantage is that with electric field curing, the cure rate tends to be constant through the thickness of a shape. Most phase changing vehicles tend to cure more rapidly on the surface than regions in the interior of the shape.

DETAILED DESCRIPTION OF THE INVENTION

Figure 1A:
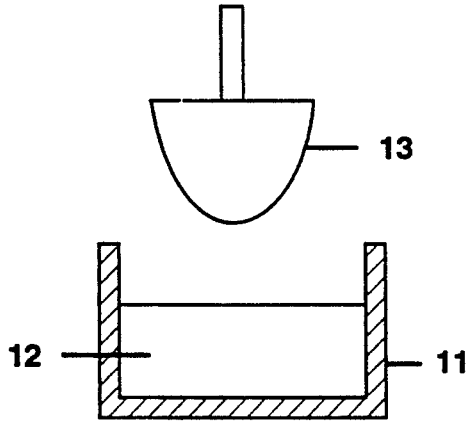
FIGS. 1*a*, 1*b* and 1*c* are side elevations, partially in section illustrating a process for making a shaped article and a shaped article in the form of a mold for making other shaped articles.

In general, any phase changing vehicle that is substantially a dielectric material is suitable for use in electroset compositions. Such materials include but are not limited to Room Temperature Vulcanizing (RTV) silicone rubber, rubber cement, oil based paints, liquid plastic coating materials, thermoplastics, polymers such as polyester, polyurethane, epoxy compositions or other spreadable or moldable dielectric materials. Conductive fluids such as paint thinner or varnish remover are not expected to be good vehicles and neither is a fluid wherein the water content is high.

Shapes of various forms are formed using materials of the present invention. The shapes are permitted to change state, that is to harden, cure or solidify normally; or, their change of state is accelerated by applying an electric field to the shape, much in the same manner as an electric field is applied to an electroviscous fluid to cause the fluid to temporarily solidify. Set out below are examples of embodiments of the present invention.

EXAMPLE 1

An aggregate was first made similarly as type aggregate in my copending application Ser. No. 07/219,522 pending. The aggregate was made by mixing about 200 milliliters (ml) of aluminum powder, about 450 ml of graphite powder, about 2100 ml of glass microsphers, about 425 ml of a ceramic material with the commercial name of Quickwall and produced by the Quickrete Co. and about 800 ml of water. The composition was thoroughly stirred with an egg beater for about 5 minutes and then allowed to stand and harden. After hardening, the aggregate block thus formed was broken up into fine particles and sifted through a tea strainer to obtain a powder. The powder was baked in an oven at about 450° F. (232° C.) for about an hour to ensure that it was anhydrous.

One part by volume of the aggregate thus obtained was mixed with one part by volume silicone rubber as manufactured by the General Electric Company and one part by volume 50 centistoke (cs) dimethyl silicone oil as manufactured by the Dow Corning Co. This composition was put into a beaker. An electric probe comprising two electrodes with a spacing gap of about 3 to 4 millimeters (mm) was inserted into the composition. The construction of the probe and the procedure for energizing the probe are disclosed in my copending applications discussed above. In the test results reported herein, the probe consisted of two aluminum plates, each having a surface area of about one $in^2$ (about 6.5 $cm^2$) and a spacing of about 3 to 4 mm. The probe was energized with a potential of about 6000 volts dc. It was found that the fluid in the beaker behaved generally as an electroviscous fluid, that is, when the probe was energized, the "solidified" fluid could be withdrawn from the beaker and when the potential was removed, the fluid would revert to a liquid and drop from the probe. The probe was again inserted into the beaker, energized with about 6000 volts dc to pick up fluid and withdrawn from the beaker. The material remained in its solidified state via the Winslow effect. Occasionally, arcing would occur and the potential was reduced to eliminate the arcing. After 10 minutes, it was surprisingly found that the material between the plates of the probe had hardened into a solid material and remained on the probe after the potential was removed. On the other hand, a similar 3 to 4 mm thickness of the same composition and of about the same surface area required about 12 hours to set and harden to a comparable hardness as the hardened composition between the plates of the probe.

In each of the foregoing examples 2 through 11, the same test procedure was used for the materials as was used for Example 1 above. The results of tests for these compositions is reported below. The term electroset time is used to describe the results of cure time with electric potential applied, the potential being gradually reduced from the value stated to mitigate any arcing as occurred. The term, self cure time, is used to describe the time that it took for a similar sized sample of the same composition to cure with no potential applied.

EXAMPLE 2

| | |
|---|---|
| Phase changing vehicle: | Rustoleum wood saver paint (light gray σ7180), manufactured by Rustoleum Corp., Vernon Hills, CA. |
| Aggregate: | As described in Example 1 |
| Composition: | About 3 parts by volume Phase Changing Vehicle with 2 about parts by volume aggregate. |
| Applied Potential: | About 6000 volts dc |
| Electroset time: | 30 minutes |
| Self cure time: | Greater than 24 hours |

EXAMPLE 3

| | |
|---|---|
| Phase changing vehicle: | Varathane liquid plastic, clear gloss type, manufactured by the Flecto Co. of Oakland, CA. |
| Aggregate: | As described in E tample 1 |
| Composition: | About 3 parts by volume Phase Changing Vehicle with about 2 parts by volume aggregate |
| Applied Potential: | about 6000 volts dc |
| Electroset time: | about 20 minutes |
| Self cure time: | greater than 24 hours |

EXAMPLE 4

| | |
|---|---|
| Phase changing vehicle: | Polyurethane clear plastic coating sold under the Channel Home Center brand name |
| Aggregate: | As described in Example 1 |
| Composition: | About 3 parts by volume Phase Changing Vehicle with about 2 parts by volume aggregate. |
| Applied Potential: | About 6000 volts dc |
| Electroset time: | About 40 minutes |
| Self cure time: | About 6 hours |

EXAMPLE 5

| | |
|---|---|
| Phase changing vehicle: | Fabulon Ultra Gloss Epoxy Bar Top Finish manufactured by the Fabulon Products Co. of Buffalo, NY |
| Aggregate: | As described in Example 1 |
| Composition: | About 3 parts by volume Phase Changing Vehicle with about 2 parts by volume aggregate. |
| Initial Potential: | About 6000 volts dc |
| Electroset time: | About 25 minutes |
| Self cure time: | Greater than 6 hours |

EXAMPLE 6

| | |
|---|---|
| Phase changing vehicle: | Rubber Cement as manufactured by Papercraft Co. of Pittsburg Pa. |
| Aggregate: | As described in Example 1 |
| Composition: | About 2 parts by volume Phase Changing Vehicle with about 1 part by volume aggregate. |
| Applied Potential: | About 6000 volts dc |
| Electroset time: | About 35 minutes |
| Self cure time: | Greater than 10 hours |

In Examples 1 through 6, the aggregate used to make the compositions is essentially an aggregate disclosed in my copending application Ser. No. 07/219,522 referenced above. In the foregoing examples 7 through 11, other aggregates are used which have been previously noted in the art as being suitable materials for making electroviscous fluids.

EXAMPLE 7

| | |
|---|---|
| Phase changing vehicle: | About one part by volume RTV silicone rubber of the type described in Example 1 mixed with about 1 part by volume dimethyl silicone oil also of the type described in Example 1 |
| Aggregate: | Corn starch sold under the brand name Cream and distributed by the Dial Corporation of Phoenix, AZ. |
| Composition: | About 2 parts by volume Phase Changing Vehicle with about 1 part by volume aggregate. |
| Applied Potential: | About 6000 volts dc |
| Electroset time: | About 15 minutes |
| Self cure time: | Greater than 12 hours |

EXAMPLE 8

| | |
|---|---|
| Phase changing vehicle: | About one part by volume RTV silicone rubber of the type described in Example 1 mixed with about 1 part by volume dimethyl silicone oil also of the type described in Example 1 |
| Aggregate: | Crystalline cellulose particles sold by the FMC Corp. of Philadelphia, Pa. also known as microcrystalline cellulose powder sold under product name PH 102 |
| Composition: | About 2 parts by volume Phase Changing Vehicle with about 1 part by volume aggregate. |
| Applied Potential: | About 6000 volts dc |
| Electroset time: | About 15 minutes |
| Self cure time: | Greater than 12 hours |

EXAMPLE 9

| | |
|---|---|
| Phase changing vehicle: | Rustoleum wood saver paint (light gray σ7180), manufactured by Rustoleum Corp., Vernon Hills, CA. |
| Aggregate: | Corn starch sold under the brand name Cream and distributed by the Dial Corporation of Phoenix, AZ. |
| Composition: | About 3 parts by volume Phase Changing Vehicle with about 2 parts by volume aggregate. |
| Applied Potential: | About 6000 volts dc |
| Electroset time: | About 30 minutes |
| Self cure time: | Greater than 6 hours |

EXAMPLE 10

| | |
|---|---|
| Phase changing vehicle: | Varathane liquid plastic, clear gloss type, manufactured by the Flecto Co. of Oakland, CA. |
| First Aggregate: | Silica gel |
| Second Aggregate: | Graphite powder |
| Composition: | About 3 parts by volume Phase Changing Vehicle with 2 parts by volume first aggregate and .02 parts by volume second aggregate. |
| Applied Potential: | About 6000 volts dc |
| Electroset time: | About 30 minutes |
| Self cure time: | Greater than 6 hours |

EXAMPLE 11

| | |
|---|---|
| Phase changing vehicle: | Varathane liquid plastic, clear gloss type, manufactured by the Flecto Co. of Oakland, CA. |
| Aggregate: | Corn starch as described in Example 7 |
| Composition: | About 3 parts by volume Phase Changing Vehicle with about 2 parts by volume aggregate |
| Applied Potential: | About 6000 Volts dc |
| Electroset time: | About 35 minutes |
| Self cure time: | Greater than 6 hours |

The principles of this invention have also been found to be effective under conditions of reduced temperature where phase changing vehicles are sometimes reluctant to change phase. The extent of this effect is illustrated in the following example.

EXAMPLE 12

An electroset composition was formulated similar to the composition of Example 1. However, the constituent parts of the composition were as follows: about 20 percent by volume of Weatherguard Brand Silicone Rubber; about 30 percent by volume silicone oil of the type described in Example 1 and about 50 percent by volume aggregate as described in Example 1. Thus, the phase changing vehicle had proportions of 2 parts Silicone rubber to 3 parts silicone oil. A portion of the composition was placed between two flat conductive plates and the surface temperature of the plates was reduced to about 34° F. (about 1° C.). An electric potential of about 6000 volts dc was connected between the two plates. Surprisingly it was found that the composition rapidly solidified and cured in about 2 minutes, an even shorter time than the composition of Example 1 had cured under the same conditions. Further tests were performed as follows: Equal amounts of the composition of this example were placed in containers. One container was placed in a refrigerator at about 34° F. (about 1° C.) and the second container was allowed to remain at room temperature of about 74° F. (about 23° C.). Each of the samples was tested by placing a probe as described in Example 1 in the material container, applying a potential of about 6000 volts dc, withdrawing the probe with fluid adhering by the Winslow effect and curing the material in the electric field. The cure time of each was found to be about two minutes. Next, samples of the phase changing vehicle (no aggregate) of this example were placed in containers. One container was placed in a refrigerator at about 34° F. (about 1° C.) and the second container was allowed to remain at room temperature of about 74° F. (about 23° C.). Each of the samples was tested by placing a probe as described in Example 1 in the material container, applying a potential of about 6000 volts dc. It was observed that the phase changing vehicle alone had no accelerated curing properties under the influence of the electric field. Unaided by the electric field, compositions of this example were found not to have cured after a period of four and one-half hours. Since the composition cured under the influence of the field in about 2 minutes, the field influenced cure is accelerated by a factor of at least 135:1 as compared with an unaided cure.

The following additional test was performed. A probe as described in Example 1 was inserted in a container of the electroset composition of Example 12. A polarizing potential of about 6000 volts was applied and rather than withdrawing a sample of the electroset material from the container under the influence of the Winslow effect as was done in the examples above, the energized probe was left in the container for several minutes. After that time, the probe was withdrawn. It was found that the portion of the composition between the plates of the probe had cured, while the portion of the composition in the container that was not between the plates of the probe remained fluid. Thus it was observed that the electroset effect occurred even in the presence of composition not subjected to the field. The shape of the withdrawn cured portion generally followed the shape of the probe except for minor variations attributable to fringing of the electric field.

The examples presented in this disclosure typically had a thickness of about 3–4 mm and were cured at a declining potential beginning at a potential of about 6000 volts dc and slowly reducing the potential as the material cured. It is to be expected that variation in the potential required may vary depending on the thickness of the material: It is also expected that an optimum potential for each thickness can readily found by simple experiment. The volume ratio of aggregate to phase changing vehicle is another quantity that is expected to be varied in practice. While a volume ratio of aggregate in the composition has been varied in the examples from about 20 percent to about 40 percent by volume, it is expected that this ratio can be beyond those limits. The minimum percent aggregate is determined by the ability to cause the fluid to exhibit the Winslow effect when the electric field is applied and the maximum aggregate is determined by the preference to keep the composition initially flowable. If it is not required that the material be flowable, the aggregate can be substantially increased.

Although not desiring to be bound by theory, it is believed that the accelerated curing properties of compositions formulated in accordance with the principles of the present invention is related to the Winslow effect as that effect is now known in the field of electroviscous fluids. Although the exact mechanism for the accelerated curing is not known, it is postulated that it is related to the creation of a dipole moment within the composition as occurs in electroviscous fluids. Consequently, it is believed that the principles of the present invention are usable to accelerate the curing of any otherwise settable or curable composition, where the otherwise settable or curable composition is a reasonably good dielectric.

Figure 1B:
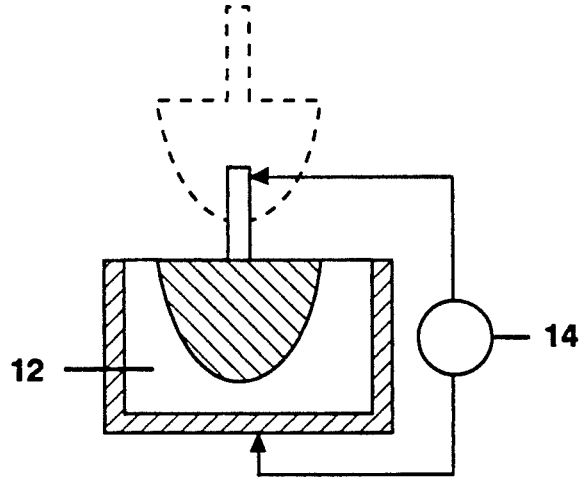
Figure 1C:
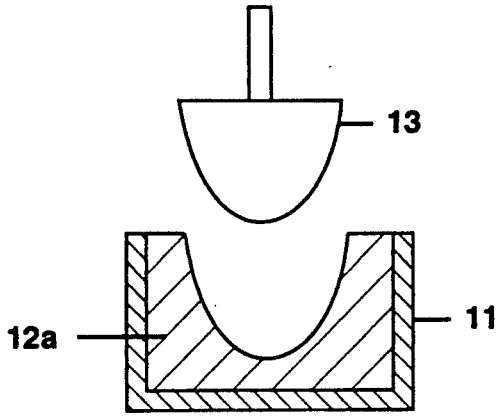
Figure 2A:
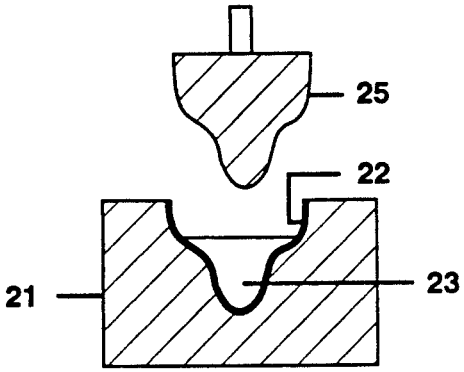
FIGS. 2*a*, 2*b*, 2*c* and 2*d* are side elevation section views illustrating a second process for making shaped articles and a shaped article formed thereby.
Figure 2B:
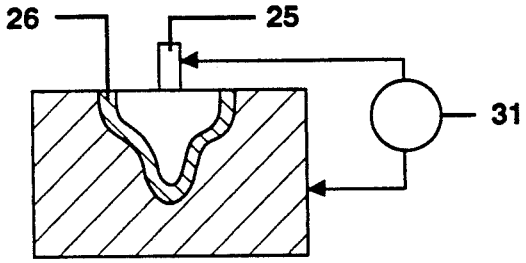
Figure 2C:
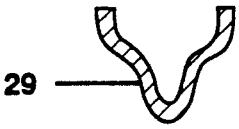
Figure 2D:
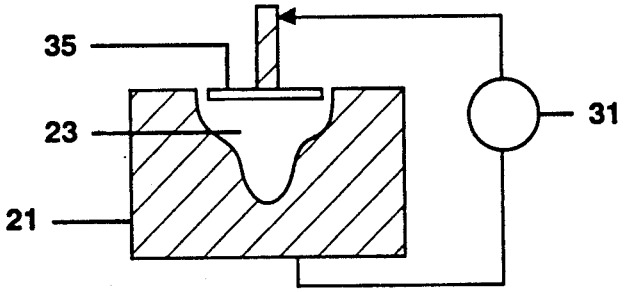

Materials made in accordance with the present invention are useful for fabricating molded articles as well as tools for making molded articles and tools of diverse kinds, the novelty of such articles and tools being in the manner of making such articles and not necessarily in the configuration of the articles or tools themselves. For example, compositions of the present invention may be used to make molds making molded or cast articles. The manner of construction of a mold for making articles is illustrated in FIG. 1. In FIG. 1*a*, reservoir 11 is partially filed with an electroset composition 12, the electroset composition being in accordance with the present invention. Plug 13, having a shape to be duplicated is positioned adjacent to reservoir 11. In FIG. 1*b*, plug 13 is inserted into composition 12 partially displacing composition 12. When composition 12 has been partially displaced, an electric potential is applied between the plug and the reservoir to cause composition 12 to electroset. Plug 13 and reservoir 11 are required to be sufficiently electrically conductive to cause charge supplied by high voltage power supply 14 to evenly distribute over the surfaces in contact with material 12. Usable conductive materials include aluminum, copper, steel, and zinc with aluminum being preferred because of its relatively low cost and ease of machining. High Voltage power supply 14 preferably has a variable range of zero to about 6000 volts dc. After the material has electroset, plug 13 is removed as illustrated in FIG. 1*c*, leaving material 12*a* within reservoir 11 generally forming the shape of plug 13. Although reservoir 11 and plug 13 are shown in simple shapes for the purpose of teaching the invention, it is to be understood that more complex shapes are also within the scope of the invention and may be readily made by using multiple piece reservoirs and plugs.

Another embodiment of a process for making articles is illustrated in FIG. 2. In FIG. 2*a* reservoir 21 has an interior wall 22 substantially the same shape as the desired external shape of the article to be formed. Reservoir 21 is substantially conductive, at least to the extent that in will readily pass currents in the range of a few micro amperes to a few milliamperes. Usable conductive materials include aluminum, copper, steel, and zinc with aluminum being preferred because of its relatively low cost and ease of machining. In operation, reservoir 21 is partially filed with an electroset composition 23, the electroset composition being in accordance with the present invention. Plug 25 has a shape substantially the same shape as the interior shape of the article to be formed is positioned adjacent to reservoir 21. In FIG. 2*b*, plug 25 is inserted into composition 23 displacing the composition to form an article with wall thickness 26. After the insertion of plug 25, an electric potential is applied between plug 25 and reservoir 21 to cause composition 23 to electroset. Plug 25 is required to be sufficiently electrically conductive in the same manner as reservoir 21 to cause charge supplied by high voltage power supply 31 to evenly distribute over the surfaces in contact with material 23. High Voltage power supply 31 preferably has a variable range of zero to about 6000 volts dc. After the material has electroset, plug 25 is removed from the interior of article 29 and article 29 is removed from reservoir 21 as illustrated in FIG. 2*c*. Although reservoir 21 plug 25 and subsequent article 29 are shown in simple shapes for the purpose of teaching the invention, it is to be understood that more complex shapes are also within the scope of the invention and may be readily made by using multiple piece reservoirs and plugs. Additionally, thick section articles are also made by using the molding configuration shown in FIG. 2*d*. In FIG. 2*d*, reservoir 21 is substantially filled with electroset composition 23 in accordance with the present invention. Electrode 35 is placed in contact with the upper surface of composition 23 and potential for setting the material is applied by high voltage supply 31. Electrode 35 is made from a conductive material such as aluminum, copper, steel, and zinc with aluminum being preferred because of its relatively low cost and ease of machining.

Figure 3:
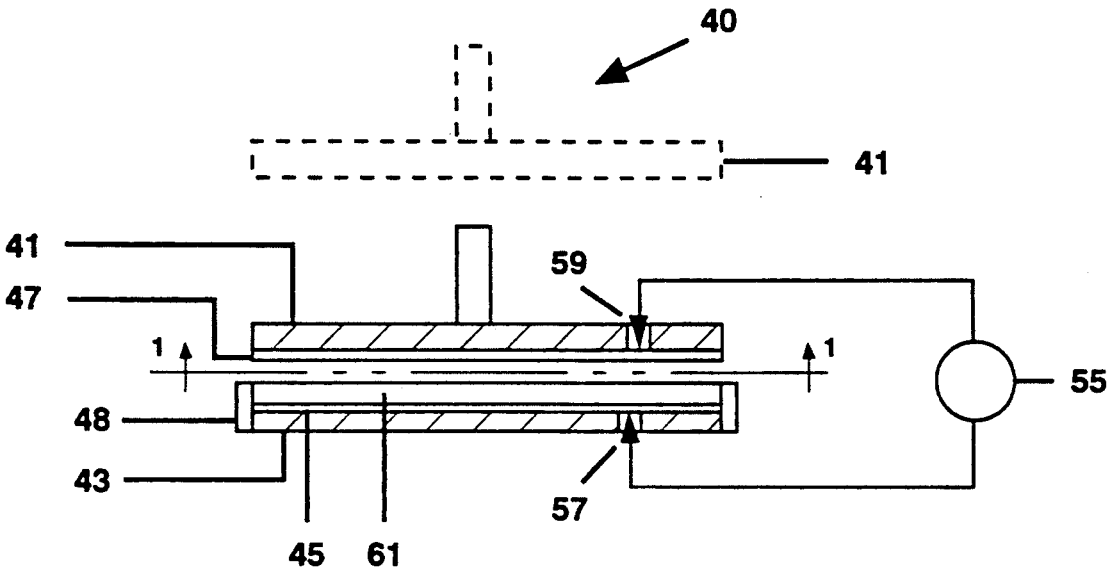
FIG. 3 is a side elevation, partially in section illustrating a process for making a shaped article such as a gasket.

The characteristic of accelerated curing of only a first portion of an electroset composition as may be in intimate contact with an electric field while portions in physical contact with the first portion but not in intimate electrical contact with an electric filed may be used to great advantage as shown in FIG. 3.

Figure 4:
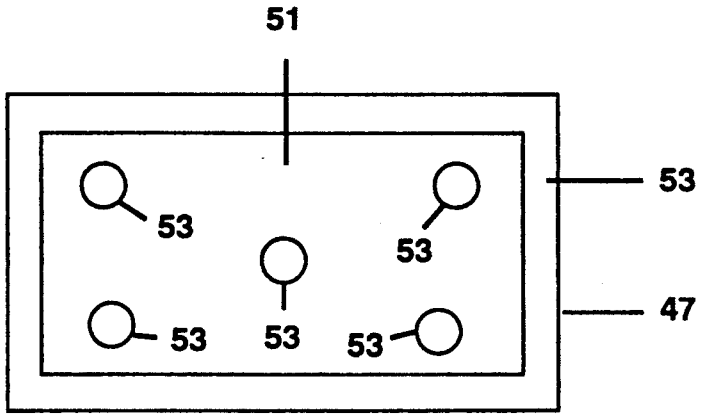
FIG. 4 is a section view of FIG. 3 taken along the lines 1—1 as shown in FIG. 3 and illustrates a typical gasket template for use with the apparatus shown in FIG. 3.

In FIG. 3 an apparatus for making an article such as for example a gasket is illustrated generally as 40. Upper and lower members 41 and 43 respectively are oppositely disposed and arranged so that upper member 41 may be readily moved from a first position as illustrated to a second position indicated in phantom. Affixed to members 41 and 43 are a pair of symmetrically opposite or mirror image platens 45 and 47 respectively. Lower member 43 is fitted with peripheral barrier 48 completely surrounding the upper surface of lower member 43. Platen 45 is shown in detail in FIG. 4, it being understood that platen 47 is similar and symmetrically opposite. Platen 45 comprises a integral conductive area 51 and may contain one or more non conductive areas indicated by 53. Conductive areas 51 of platens 45 and 47 are each connected to one polarity of voltage source 55 at 57 and 59 respectively. When assembled into upper and lower members 41 and 43 respectively, conductive areas 51 are juxtaposed. In use, electroset composition 61 is poured into the reservoir formed by the upper surface of member 43 and peripheral barrier 48. Platens 45 and 47 are moved adjacent so that the separation between conductive areas 51 defines the thickness of the gasket and both conductive areas 51 are in uniform contact with electroset composition 61. A polarizing potential is applied by power supply 55 and the composition is allowed to cure under the influence of the electric field. A completed gasket is removed and uncured portions in the areas indicated by 53 are removed leaving a completed gasket substantially shaped as area 51.

It will be appreciated by those skilled in the art in the light of this disclosure that many other kinds of electroviscous fluid aggregate particles and many other phase changing vehicles can be used without departing from the scope of the present invention. Further it will be realized that many other forms of shapes and molds for shapes may be made by practicing the principles of this invention. It is to be understood that the embodiments herein described are only illustrative of the application of the principles of the invention and that numerous modifications, alternative embodiments and arrangements may be readily devised by those skilled in the art in the light of this disclosure without departing from the spirit and scope of this invention. It is therefore to be understood what within the scope of the appended claims, the invention may be practiced otherwise than as specifically described herein.

What is claimed is:

1. A process for shaping articles, comprising:

providing a quantity of fluid electrosetting composition;

positioning a first portion of said electrosetting composition between at least two electrically conductive surfaces, said electrosetting composition comprising a phase changing vehicle which is both a dielectric and a polymer and an aggregate comprising particles which will polarize in an electric field;

electrically charging said conductive surfaces such that said first portion of said electrosetting composition solidifies electrically in the manner of an electrorheological fluid;

maintaining said charging such that the cure of said first portion of said electrosetting composition is accelerated;

wherein the part of said quantity of said electrosetting composition which was not placed between said electrically conductive surfaces remains fluid; and separating said fluid portion from the solidified first portion of said electrosetting composition.

2. A process for making articles, comprising:

positioning an electrosetting composition between first and second surfaces, each said surface having substantially opposite conductive and nonconductive portions, said electrosetting composition comprising a phase changing vehicle which is both a dielectric and a polymer and an aggregate comprising particles which will polarize in an electric field, said electrosetting composition further comprising a composition which is an electrorheological fluid, is castable or moldable and is curable in the presence of an electric field wherein the field provides electrical acceleration of the cure of said composition, wherein said cure is defined as the electrically irreversible phase change of said composition from fluid phase to solid phase, wherein said electrically irreversible phase change is defined as a solidification of said composition such that said solidification is not reversible by means of removing said composition from being positioned within an electric field;

electrically charging said conductive portions of said first and second surfaces thereby electrically energizing only the portion of said electrosetting composition between said conductive portions of said first and second surfaces while the remaining portion of said electrosetting composition is unenergized;

maintaining said charging until said energized portion of said composition adjacent the conductive portions of said first and second surfaces has cured; and separating excess uncured composition substantially corresponding to non-conductive portions of said first and second surfaces from said cured portion.

3. A process as described in claim 2 wherein the phase changing vehicle comprises polyurethane.

4. A process as described in claim 2 wherein the phase changing vehicle comprises epoxy.

5. A process as described in claim 2 wherein the particles comprise glass microspheres.

6. A process as described in claim 2 wherein the particles comprise corn starch.

7. A process as described in claim 2 wherein the phase changing vehicle comprises silicone rubber.

8. A process as described in claim 2 wherein the particles comprise aluminum.

9. A process as described in claim 2 wherein the particles comprise graphite.

10. A process as described in claim 2 wherein the phase changing vehicle comprises rubber cement.

11. A process as described in claim 2 wherein the particles comprise cellulose.

12. A process comprising:

positioning an electrosetting composition between two surfaces each said surface having substantially opposite conductive and nonconductive portions, said electrosetting composition comprising a phase changing vehicle which is both a dielectric and a polymer and an aggregate comprising particles which will polarize in an electric field;

electrically charging said conductive portions of said surfaces such that said electrosetting composition between said conductive portions of said surfaces energizes and solidifies in the manner of an electroviscous fluid, that portion of said composition between the nonconductive portions of said surfaces being unenergized and fluid;

separating said unenergized portion of said electrosetting composition from said energized portion of said composition; and, maintaining said charging until said energized portion of said electrorheological composition substantially cures.

13. A process as described in claim 12 wherein the phase changing vehicle comprises silicone rubber.

14. A process as described in claim 12 wherein the phase changing vehicle comprises polyurethane.

15. A process as described in claim 12 wherein the phase changing vehicle comprises epoxy.

16. A process as described in claim 12 wherein the electrically polarizable particles comprise cellulose.

17. A process as described in claim 12 wherein the electrically polarizable particles comprise aluminum.

18. A process as described in claim 12 wherein the electrically polarizable particles comprise graphite.

19. A process as described in claim 12 wherein the electrically polarizable particles comprise glass microspheres.

* * * * *